US005213171A

United States Patent [19]

Clench et al.

[11] Patent Number: 5,213,171

[45] Date of Patent: May 25, 1993

[54] DIAMOND DRAG BIT

[75] Inventors: Mark Clench; Saul N. Izaguirre, both of Spring, Tex.

[73] Assignee: Smith International, Inc., Houston, Tex.

[21] Appl. No.: 764,016

[22] Filed: Sep. 23, 1991

[51] Int. Cl.[5] ..... E21B 10/46

[52] U.S. Cl. ..... 175/420.1; 175/428

[58] Field of Search ..... 175/420.1, 428, 429, 175/432, 435

[56] References Cited

U.S. PATENT DOCUMENTS 4,200,159 4/1980 Peschel et al. .
4,244,432 1/1981 Rowley et al. .
4,265,324 5/1981 Morris et al. .
4,351,401 9/1982 Fielder .
4,460,053 7/1984 Jurgens et al. .
4,498,549 2/1985 Jurgens .
4,505,342 3/1985 Barr et al. ..... 175/428
4,669,556 6/1987 Barr .

*Primary Examiner*—William P. Neuder
*Attorney, Agent, or Firm*—Robert G. Upton

[57] ABSTRACT

This invention consists of a diamond drag bit having a multiplicity of cutter studs secured within strategically positioned insert holes formed by a cutter face of the drag bit body. Means are provided to support the portion of the cutting end of each of the extended insert studs protruding above the bit face.

6 Claims, 3 Drawing Sheets

DIAMOND DRAG BIT

BACKGROUND OF THE INVENTION

I. Field of the Invention

This invention relates to diamond drag bits for drilling boreholes in earthen formations.

More particularly, this invention relates to diamond drag bits having supported Stratapax type polycrystalline cutter studs strategically inserted and positioned in the face of the drag bit body.

II. Description of the Prior Art

A number of prior art patents reflect the state of the art relative to the use of diamond insert studs in diamond drag bits.

U.S. Pat. No. 4,265,324 assigned to the same assignee as the present invention teaches the use of insert studs that are counterbored in the face of a drag bit. The counterbore relieves the upper portion of the bored hole formed in the face of the bit body. The hole is formed to receive the shank of the insert stud.

The counterbore serves to clear the bottom edge of the diamond cutting face of the insert. The stud portion behind the cutting face of the insert is then supported by the bit face depending upon the depth of the counterbore.

While the novel means to support the insert stud is fairly satisfactory, the counterbore caused turbulent flow of the cooling and cleaning fluid passing by each of the diamond inserts during operation of the bit in a borehole.

The use of a counterbore to add strength to the stud cutter substantially reduced the extension of the cutter below the bit body face, thereby reducing the depth of cut or the plastic deformation of the rock reducing the drill rate.

U.S. Pat. Nos. 4,244,432 and 4,351,401 are examples of other diamond drag bits that utilize stud type diamond inserts pressed into insert holes formed in the face of the drag bit.

The foregoing patents are disadvantaged in that the cutting end of the studs are unsupported and are vulnerable to fracturing just above the face of the bit.

SUMMARY OF THE INVENTION

It is an object of this invention to provide a means to extend and support diamond stud cutter inserts for a diamond drag bit.

It is another object of the present invention to provide extended and supported diamond insert cutters in the face of a diamond drag bit with a minimum of flow turbulence of cooling and cleaning fluid exiting nozzles formed in the face of the drag bit.

A diamond drag bit apparatus is disclosed wherein the drag bit has a multiplicity of individual diamond inserts strategically inserted within insert holes formed in a face of a drag bit body. Each of the diamond inserts have a diamond cutting disc at a first cutting end with a cutting face oriented about parallel with an axis of a cylindrical shank supporting the cutting diamond disc portion.

Means are provided to additionally support the cutting end of the insert along a longitudinal surface of the insert shank 180 degrees from the cutting disc. The support means is an adjacent mass extending the length of the stud cutter shank that is exposed beyond the face of the drag bit to such an extent that provides up to an equal width over length of the stud cutter when viewed 90 degrees from the cutter disc.

The means to support the insert shank is a second cylindrical stud body inserted in insert holes formed in the face immediately adjacent to or overlapping the stud cutter insert holes. A surface of the cylindrical stud body connects to the surface of the cylindrical diamond stud cutter. The second cylindrical stud body is metallurgically bonded to the diamond insert stud body.

An alternative embodiment consists of a second cylindrical stud body having a curved concave surface formed therein that conforms to and parallels a portion of the cylindrical shank of the diamond insert.

An advantage of the present invention over the prior art is the elevation of the stud cutter above the face of the drag bit for better bit penetration while supporting the stud.

Another advantage of the present invention over the prior art is the length over width of the combined stud cutter and backup support to prevent shear of the diamond stud cutter.

Still another advantage of the present invention over the prior art is that the back-up support system allows for the maximum cutter exposure or extension, thereby permitting a significantly greater depth of cut for use in highly plastic rock.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
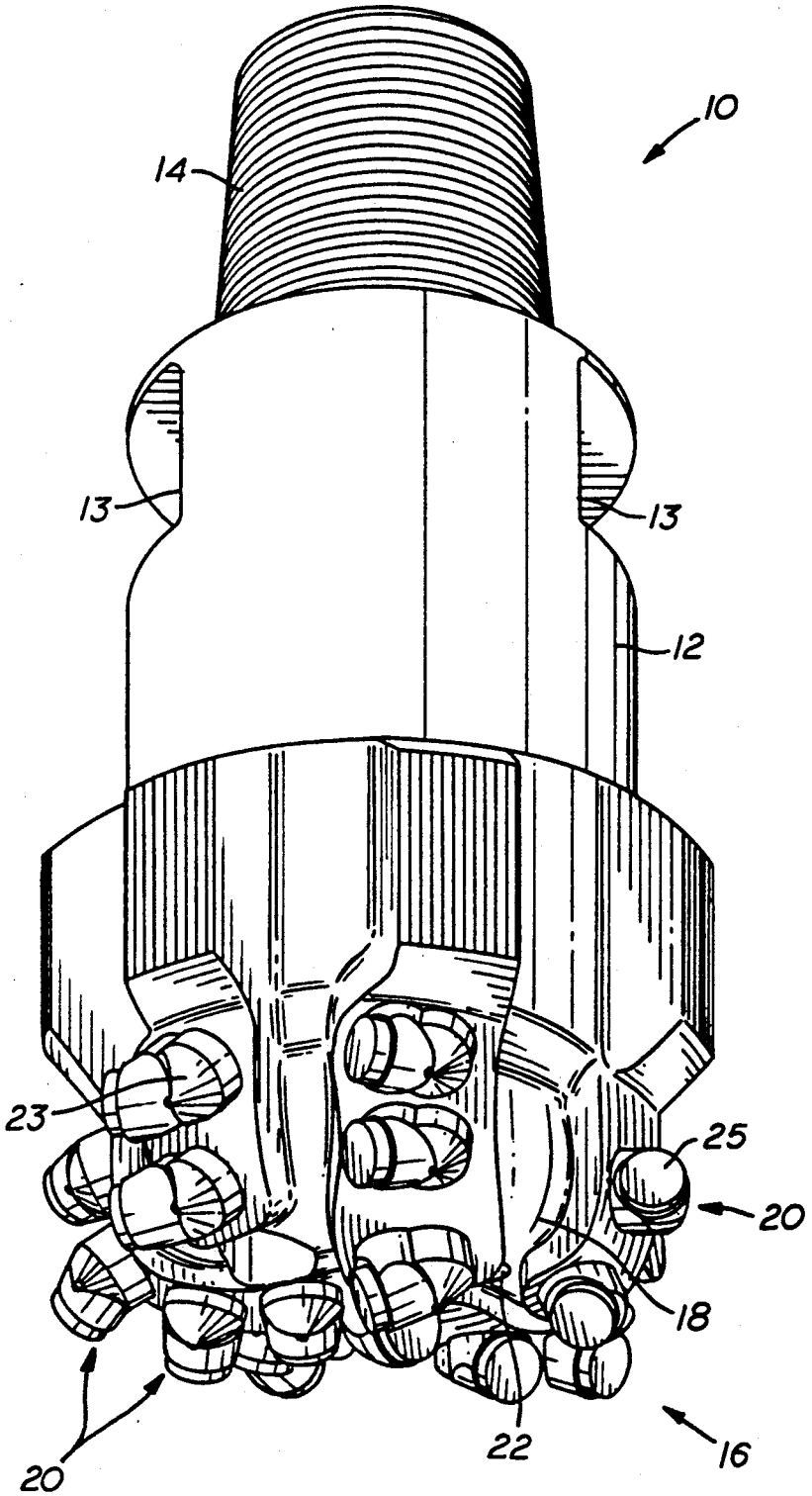
FIG. 1 is a perspective view of a diamond rock bit with stud cutter inserts secured within insert holes formed in a face of a rock bit body.

FIG. 1 depicts a diamond drag rock bit generally designated as 10. Drag bit consists of a bit body 12, threaded pin end 14 and cutting end generally designated as 16. A pair of tool groove slots 13 on opposite sides of the bit body 12 provide a means to remove the bit from a drill string (not shown).

At the cutting end 16 is formed a bit face 18 that has a multiplicity of diamond inserts generally designated as 20 extending therefrom. Inserts 20, for example, consists of a diamond disc 22, a cylindrical support backing 24 and an insert stud body 28.

The disc 22 is fabricated from a tungsten carbide substrate 24 with a diamond layer sintered to the face of the substrate. In addition, the stud body 28 is fabricated from tungsten carbide. The diamond layer on the substrate is composed of a polycrystalline material.

The synthetic polycrystalline diamond layer is manufactured by the Specialty Material Department of General Electric Company of Worthington, Ohio. The foregoing drill cutter blank is known by the trademark name of Stratapax drill blank.

Figure 2:
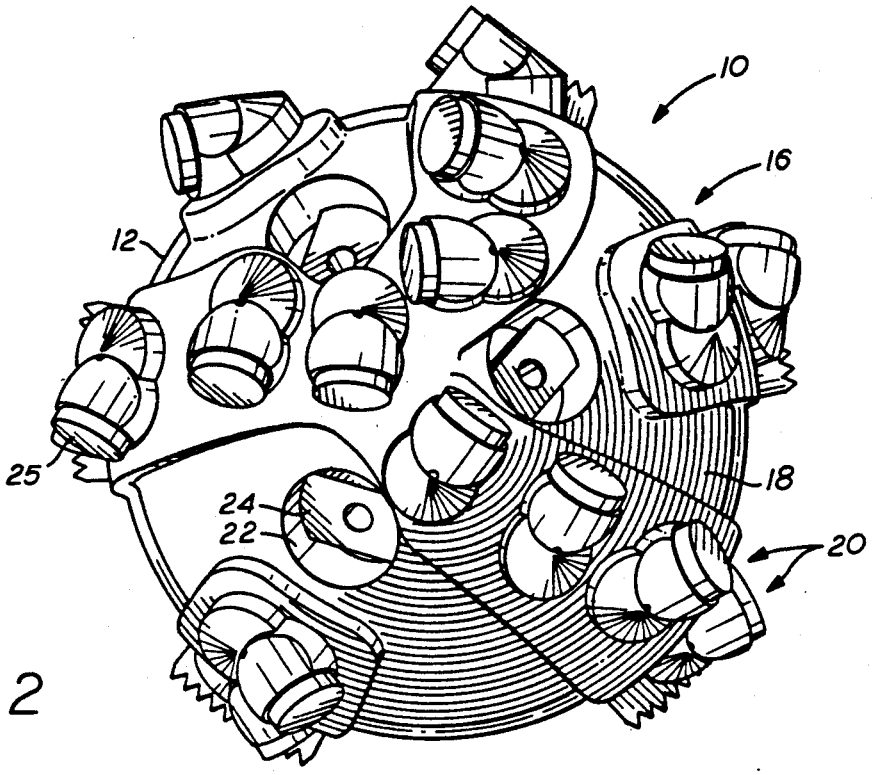
FIG. 2 is an end view of the cutting end of the drag bit.

The face 18 defines one or more fluid passages 22. Typically, cooling fluid or "mud" is pumped down a drill string into the pin end 14 and out through the fluid passages 22 in which nozzles 24 are secured (FIG. 2). The drill string that connects to the threaded pin end is not shown.

With reference now to FIG. 2, the cutting end 16 consists of a multiplicity of diamond inserts 20 imbedded in insert holes 26 formed in face 18 of bit body 12. Each insert 20 consists of a cylindrical base end 21, a cutting end 23 forming a diamond cutting surface 25. The insert, for example, is backed up by a support stud 28 that is retained within a stud insert hole 30 drilled adjacent to or overlapping insert hole 26.

Figure 3:
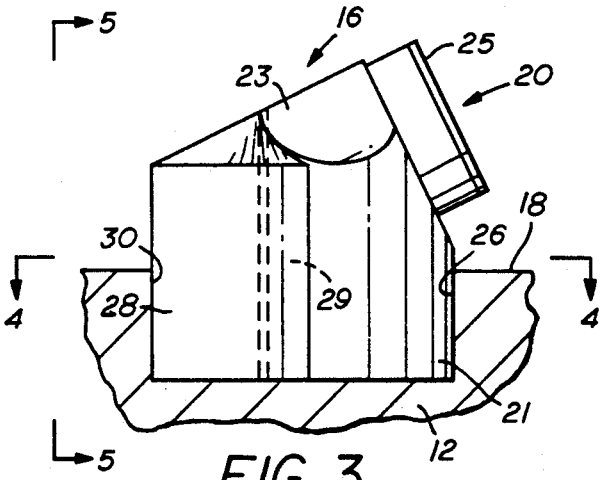
FIG. 3 is a side elevational view of a stud cutter with a backup stud supporting the cutter.
Figure 5:
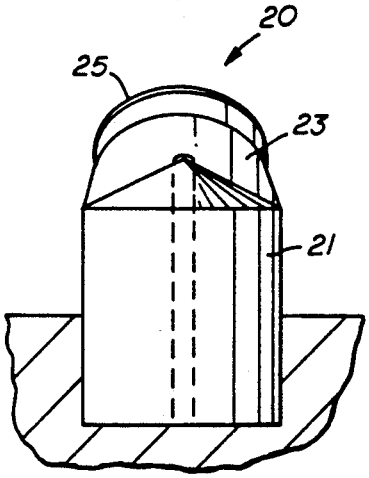
FIG. 5 is a view taken through 5—5 of FIG. 3.
Figure 4:
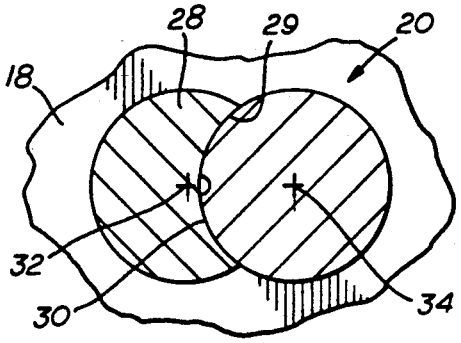
FIG. 4 is a view taken through 4—4 of FIG. 3 illustrating the backup stud connected to the cutter stud.

FIGS. 3, 4 and 5 illustrate a preferred embodiment wherein the stud 28 is crescent shaped when viewed from the end. Concave surface 29 is, for example, the same radius as the interfitted cutter 20. The length of the support stud 28 matches the length of the cutter 20.

Figure 6:
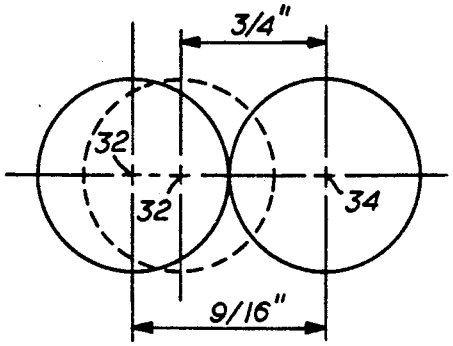
FIG. 6 is a diagrammatic illustration of a stud cutter and backup stud and their inter-relationship.

Referring now to FIGS. 3 and 6, when the stud cutter 20 and the steel backing support stud 28 are of the same width when viewed parallel to the axis that is normal to the cutter face 18 and they are rigidly fixed together at junction by, for example, brazing or other connection means (FIG. 4). The bending strength of this assembly increases approximately by the square of the distance between the axis 32 and 34 of the stud 28 and base end 21 of insert 20. Therefore, the backing support 28 is significantly useful in increasing the bending strength of the cutter 20.

FIG. 6 depicts a specific example wherein a one inch diameter cylindrical diamond cutter 20 may be offset from its backing support any distance from three-sixteenth of an inch to three-quarters of an inch. This insert, insert support assembly as described is a significant improvement and greatly resists bending shear forces as heretofore described.

The backup support stud 28 is preferably fabricated from steel, the steel support being brazed to the stud cutter 20. The foregoing assembly has five times the shear resistance of a non supported cutter 20.

An additional preference is the combination of the supported cutter 20 in a matrix bit body; the support stud 28 and cutter 20 being, for example, brazed into preformed pockets strategically located in the face 18 of the bit body 12.

Figure 7:
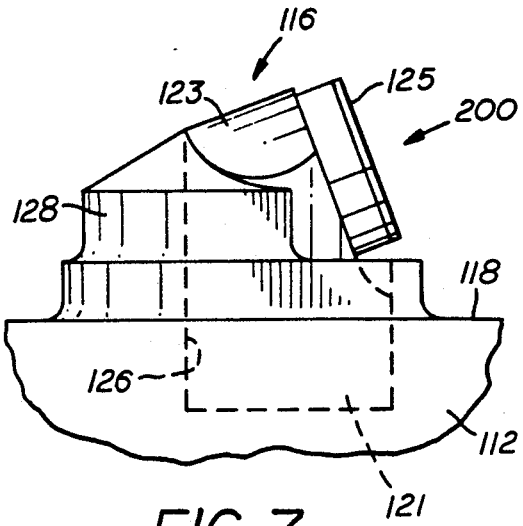
FIG. 7 is an alternative embodiment wherein the backup stud cutter support is provided by a matrix material formed from the body of the drag bit.
Figure 9:
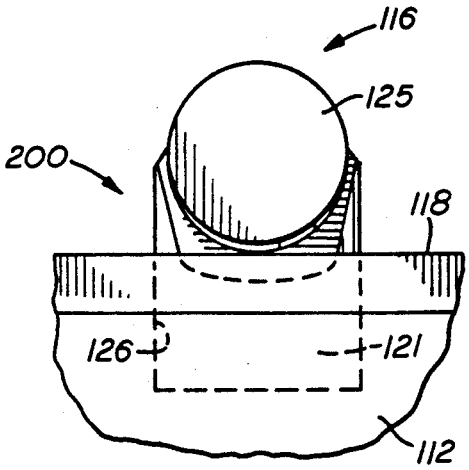
FIG. 9 is an end front view of the diamond cutter face exposed above the face of the bit body.
Figure 8:
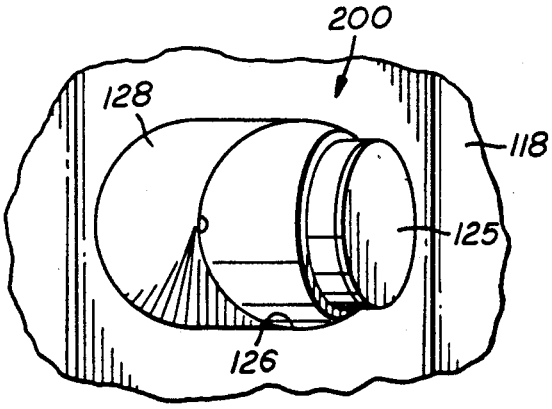
FIG. 8 is a top view taken through 8—8 of FIG. 7.

FIGS. 7, 8 and 9 refer to an alternative embodiment wherein the drag bit generally designated as 200 consists of a cutting end generally designated as 116 that is fabricated from a matrix material. Cutter insert pockets 126 are formed in the face 118. The backup support 128 is formed in the female drag bit mold (not shown). Support 128 extends along the backside of the insert 200 in the same manner as that shown in FIGS. 1 through 5.

While the steel support 28 is superior in strength to the matrix backup support 128, the combination of the insert with matrix backup is still stronger than a free standing insert 20 without support.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A diamond drag bit apparatus wherein said drag bit has a multiplicity of individual diamond insert studs strategically inserted within insert holes formed in a face of a drag bit body, said diamond inserts having a diamond cutting disc at a first cutting end with a cutting face about parallel with an axis of a cylindrical shank support portion, said drag bit comprising:

means to provide additional support for said cutting end of said insert along a longitudinal surface of said insert shank 180 degrees from said cutting disc, said means being an adjacent mass extending the length of the stud cutter shank that is exposed beyond the face of the drag bit to such an extend that provides up to an equal width over length of said stud cutter when viewed 90 degrees from said cutter, said means to support said insert shank is a second stud body inserted in insert holes formed in said face adjacent to said stud cutter insert holes, a surface of said second stud body connects to said surface of said cylindrical diamond stud cutter.

2. The invention as set forth in claim 1 wherein said second stud body is fabricated from steel.

3. The invention as set forth in claim 2 wherein said second stud body is metallurgically bonded to said diamond insert stud body.

4. The invention as set forth in claim 3 wherein said metallurgical bond is a braze.

5. The invention as set forth in claim 4 wherein said second stud body forms a curved concave surface that conforms to and parallels a portion of said cylindrical shank portion of said diamond insert.

6. The invention as set forth in claim 5 wherein said second stud body concave surface contacts said cylindrical shank of said diamond insert through about 120 degrees of said surface of said shank of said cutter.

* * * * *